US010422527B2

(12) United States Patent
Akagi

(10) Patent No.: US 10,422,527 B2
(45) Date of Patent: Sep. 24, 2019

(54) COMBUSTION APPARATUS

(71) Applicant: RINNAI CORPORATION, Aichi (JP)

(72) Inventor: Kazuyuki Akagi, Aichi (JP)

(73) Assignee: RINNAI CORPORATION, Aichi (JP)

( * ) Notice: Subject to any disclaimer, the term of this patent is extended or adjusted under 35 U.S.C. 154(b) by 101 days.

(21) Appl. No.: 15/749,253

(22) PCT Filed: Jun. 23, 2016

(86) PCT No.: PCT/JP2016/003040
§ 371 (c)(1),
(2) Date: Jan. 31, 2018

(87) PCT Pub. No.: WO2017/029772
PCT Pub. Date: Feb. 23, 2017

(65) Prior Publication Data

US 2018/0216816 A1 Aug. 2, 2018

(30) Foreign Application Priority Data

Aug. 18, 2015 (JP) ..... 2015-161302

(51) Int. Cl.
*F23D 14/62* (2006.01)
*F23K 5/00* (2006.01)
(Continued)

(52) U.S. Cl.
CPC ..... *F23D 14/62* (2013.01); *F23K 5/007* (2013.01); *F23L 5/02* (2013.01); *F23L 13/02* (2013.01);
(Continued)

(58) Field of Classification Search
CPC .. F23D 14/62; F23N 1/00; F23L 13/02; F23L 5/02; F23K 5/00
(Continued)

(56) References Cited

U.S. PATENT DOCUMENTS 8,827,693 B2 * 9/2014 Akagi ..... F23D 14/62 431/326
9,523,515 B2 * 12/2016 Park ..... F24H 1/186
(Continued)

FOREIGN PATENT DOCUMENTS

JP 54-032840 A 3/1979
JP 2015-519532 A 7/2015
(Continued)

OTHER PUBLICATIONS

International Search Report and Written Opinion for PCT Patent App. No. PCT/JP2016/003040 (dated Sep. 13, 2016) with English translation of the ISR.

*Primary Examiner* — Gregory L Huson
*Assistant Examiner* — Nikhil P Mashruwala
(74) *Attorney, Agent, or Firm* — Cermak Nakajima & McGowan LLP; Tomoko Nakajima

(57) ABSTRACT

A combustion apparatus having: an upstream-side air supply chamber and a downstream-side mixing passage, both being respectively interposed between a fan and a burner; and a zero governor which is interposed in a gas supply passage and which adjusts a secondary gas pressure to a pressure equivalent to an internal pressure in the air supply chamber, thereby enabling to maximize a turndown ratio to the extent possible. The combustion apparatus has: first and second, totally two, mixing passages; a first gas outlet which is in communication with a narrowed part of the first mixing passage; a second gas outlet which is in communication with a narrowed part of the second mixing passage; a first air valve which varies an opening degree of an air inlet of the first mixing passage; a second air valve which varies an opening degree of an air inlet of the second mixing passage; and a gas valve.

5 Claims, 4 Drawing Sheets

(51) Int. Cl.
*F23N 1/02* (2006.01)
*F23L 5/02* (2006.01)
*F23L 13/02* (2006.01)

(52) U.S. Cl.
CPC ..... *F23N 1/027* (2013.01); *F23D 2203/007* (2013.01); *F23D 2900/00003* (2013.01); *F23N 2035/02* (2013.01)

(58) Field of Classification Search
USPC ..... 431/89
See application file for complete search history.

(56) References Cited

U.S. PATENT DOCUMENTS

| | | | | |
|---|---|---|---|---|
| 9,841,187 | B2 * | 12/2017 | Takeuchi | F23D 14/02 |
| 10,215,404 | B2 * | 2/2019 | Lee | F23D 14/60 |
| 2002/0192615 | A1 | 12/2002 | Moriya et al. | |
| 2004/0144094 | A1 | 7/2004 | Moriya et al. | |
| 2004/0144095 | A1 | 7/2004 | Moriya et al. | |
| 2004/0148936 | A1 | 8/2004 | Moriya et al. | |
| 2005/0037305 | A1 | 2/2005 | Moriya et al. | |
| 2015/0086931 | A1 | 3/2015 | Kim et al. | |
| 2015/0345784 | A1 | 12/2015 | Lee et al. | |
| 2016/0161114 | A1 * | 6/2016 | Ranalli | F23D 14/36 48/180.1 |

FOREIGN PATENT DOCUMENTS

| | | | |
|---|---|---|---|
| WO | WO01/44720 | A1 | 6/2001 |
| WO | WO2014/088192 | A1 | 6/2014 |

* cited by examiner

COMBUSTION APPARATUS

This application is a national phase entry under 35 U.S.C. § 371 of PCT Patent Application No. PCT/JP2016/003040, filed on Jun. 23, 2016, which claims priority under 35 U.S.C. § 119 to Japanese Patent Application No. 2015-161302, filed Aug. 18, 2015, both of which are incorporated by reference.

TECHNICAL FIELD

The present invention relates to a combustion apparatus which is provided with a burner, and a combustion fan for supplying the burner with primary air.

BACKGROUND ART

As this kind of combustion apparatus, there is known one comprising: an upstream-side air supply chamber and a downstream-side mixing passage interposed between a combustion fan and a burner; a zero governor which is interposed in a gas supply passage for supplying fuel gas to the burner so that a secondary gas pressure is adjusted to a pressure equivalent to an internal pressure inside the air supply chamber. The mixing passage has disposed therein a narrowed part in order to accelerate a flow speed of the primary air, thereby making the internal pressure lower than the internal pressure in the air supply chamber. The narrowed part has communicated thereto a gas outlet port at a downstream end of the gas supply passage (see, for example, Patent Document 1). In this arrangement, a differential pressure between an internal pressure in the air supply chamber and an internal pressure in the narrowed part varies in proportion to the amount of supply of the primary air from the combustion fan. Then, the amount of supply of the fuel gas from the gas outlet port which is in communication with the narrowed part varies in proportion to the differential pressure between the secondary gas pressure that is equivalent to the internal pressure in the air supply chamber and the internal pressure in the narrowed part, that is, varies in proportion to the amount of supply of the primary air from the combustion fan. Therefore, by controlling the number of revolution of the combustion fan according to the required combustion amount, the primary air and the fuel gas will naturally be supplied to the burner in an amount according to the required combustion amount.

However, once the number of revolution of the fan has fallen below a lower-limit number of revolution at which the proportional characteristics of the air supply amount can be maintained, the primary air and the fuel gas according to the required combustion amount can no longer be supplied. As a solution, an arrangement was also conventionally considered to dispose an air adjusting valve which varies the opening degree of an air inlet port at an upstream end of the mixing passage such that, in a region in which the required combustion amount falls below a predetermined value which corresponds to the lower-limit value of the revolution of the fan, in a state in which the number of revolution of the fan is maintained at the lower-limit number of revolution, the opening degree of the air inlet port is adjusted by the air adjusting valve, whereby the primary air and the fuel gas can be supplied to the burner in an amount corresponding to the required combustion amount below the predetermined value.

Further, there is also known a combustion apparatus in which a proportional valve is interposed in a gas supply passage. In this kind of combustion apparatus of proportional valve system, a mixing passage is disposed between a combustion fan and a burner or on an upstream side of the combustion fan, and this mixing passage is communicated with a gas outlet port which is on a downstream end of the gas supply passage. In this arrangement, too, once the number of revolution of the fan has fallen below the lower-limit number of revolution at which the proportional characteristics of the air supply amount can be maintained, the primary air according to the required combustion amount can no longer be supplied. As a solution, in a manner similar to the above-mentioned zero governor system of combustion apparatus, there must be disposed an air adjusting valve which varies the opening degree of the air inlet port at an upstream end of the mixing passage such that, in a region in which the required combustion amount falls below a predetermined value corresponding to the lower-limit value of the revolution of the fan, in a state in which the number of revolution of the fan is maintained at the lower-limit number of revolution, the opening degree of the air inlet port is adjusted by the air adjusting valve, whereby the primary air can be supplied in an amount corresponding to the required combustion amount below the predetermined value.

However, if the opening degree of the air inlet port is throttled beyond a certain limit, the amount of the primary air may fluctuate due to minute displacements of the air adjusting valve, resulting in lack of stability in the amount of the primary air. Therefore, the opening degree of the air inlet port will have to be adjusted within a range above a predetermined lower-limit opening degree at which the amount of the primary air becomes stable. Accordingly, the lower limit of the combustion amount will also become a value corresponding to this lower-limit opening degree and, as a result, the turndown ratio cannot be made so large.

PRIOR ART DOCUMENT

Patent Document

Patent Document 1: JP-1979-32840 A

SUMMARY OF THE INVENTION

Problems that the Invention is to Solve

In view of the above points, this invention has a problem of providing a combustion apparatus in which the turndown ratio can be made large to the best extent possible.

Means of Solving the Problems

In order to solve the above problems, the first invention of this application is a combustion apparatus comprising: a burner; a combustion fan for supplying the burner with primary air; an upstream-side air supply chamber and a downstream-side mixing passage, both being interposed between the combustion fan and the burner; a zero governor which is interposed in a gas supply passage for supplying the burner with fuel gas and which adjusts a secondary gas pressure to a pressure equivalent to an internal pressure in the air supply chamber, the mixing passage having disposed therein a narrowed part in order to accelerate a flow speed of the primary air, thereby making an internal pressure lower than the internal pressure in the air supply chamber, the narrowed part having communicated thereto a gas outlet port at a downstream end of the gas supply passage; and an air adjusting valve which varies an opening degree of an air inlet port at an upstream end of the mixing passage, wherein the improvement comprises the following features. As the mixing passage, there are disposed: a first mixing passage; and a cylindrical second mixing passage enclosing the first mixing passage. As the gas outlet port, there are disposed: a first gas outlet port which is in communication with a first narrowed part which is disposed in the first mixing passage; and a second gas outlet port which is in communication with a second narrowed part which is disposed in the second mixing passage; and a gas valve in a manner to be capable of stopping the flow of the fuel gas from the first gas outlet port. As the air adjusting valve, there are disposed: a first air adjusting valve which varies the opening degree of a first air inlet port at an upstream end of the first mixing passage; and a second air adjusting valve which varies the opening degree of a second air inlet port at an upstream end of the second mixing passage. As a control mode there are included: a high-performance mode in which both the first and the second air inlet ports are opened by both the first and the second air adjusting valves, thereby allowing the primary air to flow through both the first and the second mixing passages; and a low-performance mode in which the first air inlet port is closed by the first air adjusting valve, thereby allowing the primary air to flow only through the second mixing passage and, also, stopping by the gas valve the gas flow from the first gas outlet port. The high-performance mode includes: an opening degree variable mode in which, in a state in which the number of revolution of the combustion fan is maintained at a predetermined lower-limit number of revolution, the opening degree of the first air inlet port is varied, within a range above a predetermined lower-limit opening degree, according to a required combustion amount of the burner; and a number-of-fan-revolution variable mode in which, in a state in which the opening degree of the first air inlet port is maintained above a maximum opening degree in the opening degree variable mode, the number of revolution of the combustion fan is varied, within a range above the predetermined lower-limit number of revolution of the combustion fan, according to the required combustion amount of the burner. The low-performance mode includes: an opening degree variable mode in which, in a state in which the number of revolution of the combustion fan is maintained at the predetermined lower-limit number of revolution, the opening degree of the second air inlet port is varied, within a range above a predetermined lower-limit opening degree, according to a required combustion amount of the burner; and a number-of-fan-revolution variable mode in which, in a state in which the opening degree of the second air inlet port is maintained above a maximum opening degree in the opening degree variable mode, the number of revolution of the combustion fan is varied, within a range above the lower-limit number of revolution of the combustion fan, according to the required combustion amount of the burner.

Further, the second invention of this application is a combustion apparatus comprising: a burner; a combustion fan for supplying the burner with primary air; a mixing passage disposed between the combustion fan and the burner or on an upstream side of the combustion fan; a proportional valve interposed in a gas supply passage which supplies the burner with fuel gas, a gas outlet port at a downstream end of the gas supply passage being in communication with the mixing passage; and an air adjusting valve which varies an opening degree of the air inlet port at an upstream end of the mixing passage, wherein the improvement comprises the following features. As the mixing passage, there are disposed: a first mixing passage; and a cylindrical second mixing passage enclosing the first mixing passage. As the gas outlet port, there are disposed: a first gas outlet port which is in communication with the first mixing passage; and a second gas outlet port which is in communication with the second mixing passage; and a gas valve which is disposed in a manner to be capable of stopping the flow of the fuel gas out of the first gas outlet port. As the air adjusting valve, there are disposed: a first air adjusting valve which varies the opening degree of a first air inlet port at an upstream end of the first mixing passage; and a second air adjusting valve which varies the opening degree of a second air inlet port at an upstream end of the second mixing passage. As a control mode there are included: a high-performance mode in which both the first and the second air inlet ports are opened by both the first and the second air adjusting valves, thereby allowing the primary air to flow through both the first and the second mixing passages, and fuel gas in an amount corresponding to the required amount of combustion of the burner is supplied by the proportional valve; and a low-performance mode in which the first air inlet port is closed by the first air adjusting valve, thereby allowing the primary air to flow only through the second mixing passage and also in a state in which the flow of the fuel gas out of the first gas outlet port is stopped by the gas valve, the fuel gas in an amount corresponding to the required amount of combustion of the burner is supplied by the proportional valve. The high-performance mode includes: an opening degree variable mode in which, in a state in which the number of revolution of the combustion fan is maintained at a predetermined lower-limit number of revolution, the opening degree of the first air inlet port is varied, within a range above a predetermined lower-limit opening degree, corresponding to a required combustion amount of the burner; and a number-of-fan-revolution variable mode in which, in a state in which the opening degrees of the first and the second air inlet ports are maintained above a maximum opening degree in the opening degree variable mode, the number of revolution of the combustion fan is varied, within a range above the lower-limit number of revolution of the combustion fan, according to the required combustion amount of the burner. The low-performance mode includes: an opening degree variable mode in which, in a state in which the number of revolution of the combustion fan is maintained at the predetermined lower-limit number of revolution, the opening degree of the second air inlet port is varied, within a range above a predetermined lower-limit opening degree, according to a required combustion amount of the burner; and a number-of-fan-revolution variable mode in which, in a state in which the opening degree of the second air inlet port is maintained above a maximum opening degree in the opening degree variable mode, the number of revolution of the combustion fan is varied, within a range above the lower-limit number of revolution of the combustion fan, according to the required combustion amount of the burner.

According to this invention, in either of the first invention and the second invention, the primary air flows only through the second mixing passage in the low-performance mode. Therefore, the primary air amount when the opening degree of the second air inlet port is throttled down to the lower-limit opening degree in the opening degree variable mode of the low-performance mode becomes considerably smaller than the primary air amount when the opening degree of the single air inlet port of the mixing passage is throttled down to the lower-limit opening degree, without dividing the mixing passage into both the first and the second mixing passages. Therefore, it is possible to make considerably smaller the lower limit of the combustion amount, thereby making the turndown ratio lager to the extent possible.

Still furthermore, in this invention the combustion apparatus preferably further comprises, suppose that a direction opposite to both the first and the second air inlet ports is defined as an X-axis direction and that, in the X-axis direction, the direction approaching both the first and the second air inlet ports is defined as X-axis plus direction, a common actuator which is adapted to move both the first and the second air adjusting valves in the X-axis direction. According to this arrangement, as compared with an example in which respective actuators are provided so as to move the first and the second air adjusting valves, cost down can be attained.

In this case, in order to enable the control in the high-performance mode and in the low-performance mode, the following arrangement is necessary, i.e., that: when both the first and the second air adjusting valves are moved in the X-axis plus direction, before the second air adjusting valve reaches a totally closed position at which the second air inlet port is closed, the first air adjusting valve reaches a totally closed position at which the first air adjusting valve closes the first air inlet port; that a spring is interposed between the first air adjusting valve and the second air adjusting valve such that, once the first air adjusting valve has reached the totally closed position, the second air adjusting valve is moved, while compressing the spring, in the X-axis plus direction; and also that, at the time point when the first air adjusting valve has reached the totally closed position, the second air adjusting valve is present at a position in which the opening degree of the second air inlet port is above the maximum opening degree in the opening degree variable mode of the low-performance mode.

Further, in this invention, preferably the gas valve is constituted by a valve which is mechanically connected to the first air adjusting valve and which is capable of closing the first gas outlet port and, when the first air adjusting valve has reached the totally closed position at which the first air inlet port is closed, the gas valve closes the first gas outlet port. According to the above arrangement, the construction can be simplified and the cost down can be attained.

MODES FOR CARRYING OUT THE INVENTION

Figure 1:
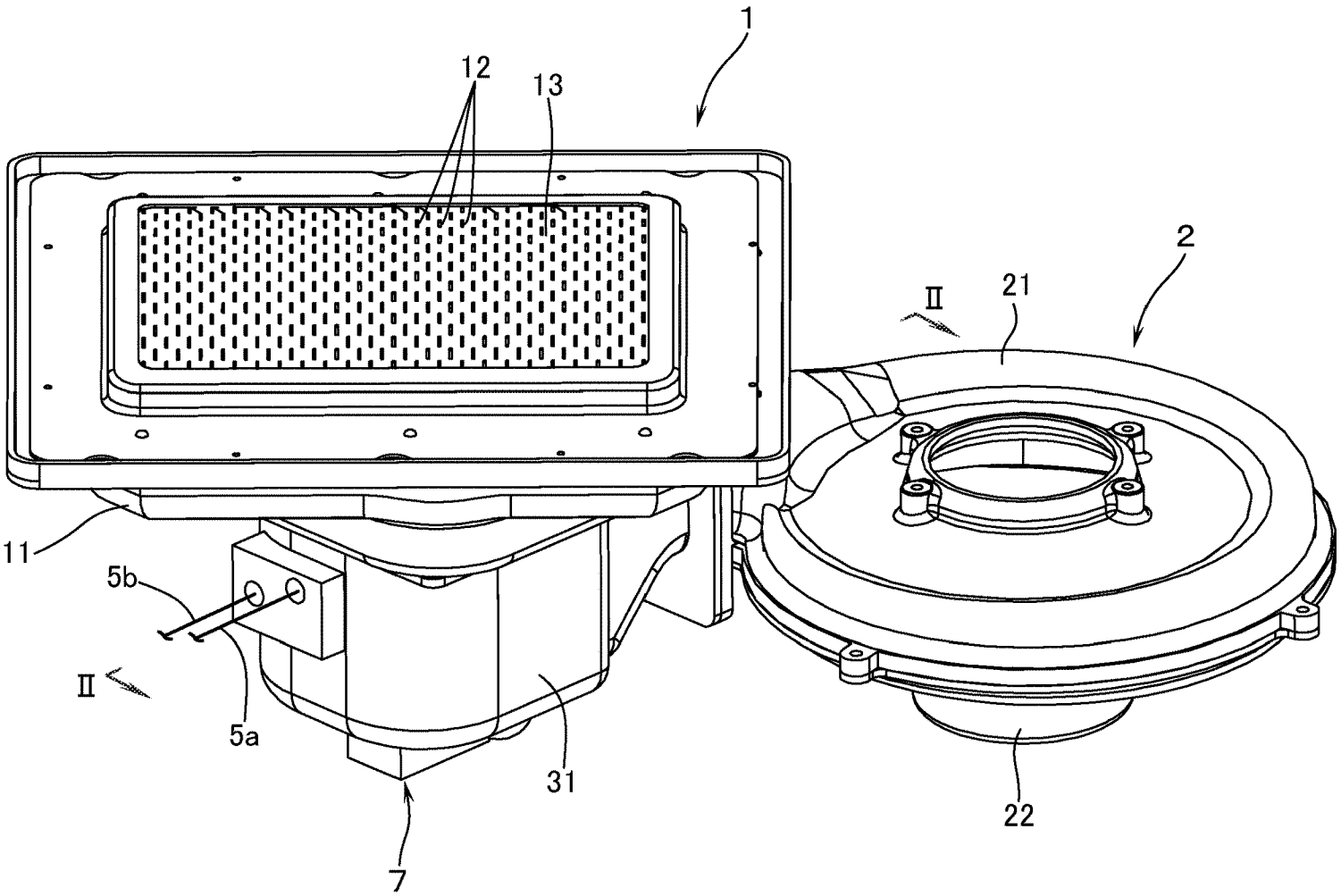
FIG. 1 is a perspective view showing a combustion apparatus according to an embodiment of this invention.
Figure 2:
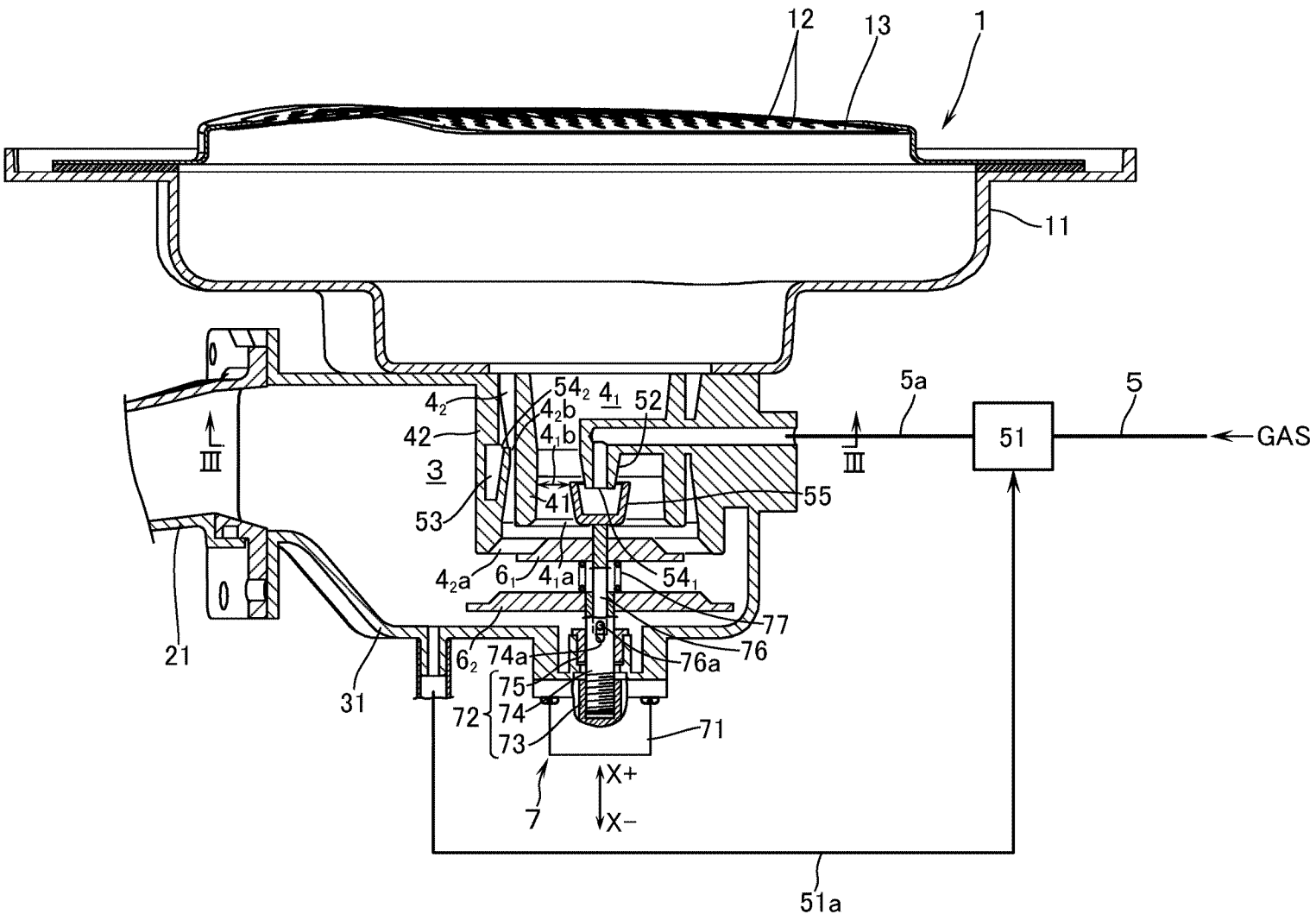
FIG. 2 is a sectional view taken along the line II-II in FIG. 1.

With reference to FIGS. 1 and 2, a combustion apparatus according to an embodiment of this invention is provided with a burner 1 and a combustion fan 2 which supplies the burner 1 with primary air. The burner 1 is constituted by a totally primary air combustion burner having mounted, on an open surface of a box-shaped burner body 11 with one surface left open, a combustion plate 13 with a multiplicity of flame holes 12 such that a mixture of the primary air and fuel gas to be supplied into the burner body 11 is ejected through the flame holes 12 for combustion. Further, the combustion fan 2 is constituted by a centrifugal fan in which an impeller to be driven by rotation of a motor 22 is housed inside a fan casing 21.

Between the combustion fan 2 and the burner 1 there are interposed: an air supply chamber 3 on an upstream side; a first mixing passage $\mathbf{4}_1$ on a downstream side; and a tubular second mixing passage $\mathbf{4}_2$ which encloses the first mixing passage $\mathbf{4}_1$. The air supply chamber 3 is formed inside an air supply case 31 which is connected to the fan casing 21. In a portion of disposing the mixing passages inside the air supply case 31, there are disposed inner and outer dual tubes 41 and 42. The internal space of the inner tube 41 constitutes the first mixing passage $\mathbf{4}_1$, and a cylindrical space between the inner tube 41 and the outer tube 42 constitutes the second mixing passage $\mathbf{4}_2$. The primary air flows into each of the first and the second mixing passages $\mathbf{4}_1$, $\mathbf{4}_2$, from upstream-end first and second air inlet ports $\mathbf{4}_1a$, $\mathbf{4}_2a$ which are in communication with the air supply chamber 3. Further, the first mixing passage $\mathbf{4}_1$ is provided with a first narrowed part $\mathbf{4}_1b$ which is positioned between an outer peripheral surface of a cup-shaped gas valve 55, which will be described in more detail later, and an inner peripheral surface of the inner tube 41. The second mixing passage $\mathbf{4}_2$ is provided with a second narrowed part $\mathbf{4}_2b$ which is positioned between a diametrically inward reduced-diameter portion formed on an inner peripheral surface of the outer tube 42 and an outer peripheral surface of the inner tube 41. The flow speed of the primary air is accelerated at each of the first and the second narrowed parts $\mathbf{4}_1b$, $\mathbf{4}_2b$ so that the internal pressure at each of the first and the second narrowed parts $\mathbf{4}_1b$, $\mathbf{4}_2b$ becomes lower than the internal pressure in the air supply chamber 3.

Figure 3:
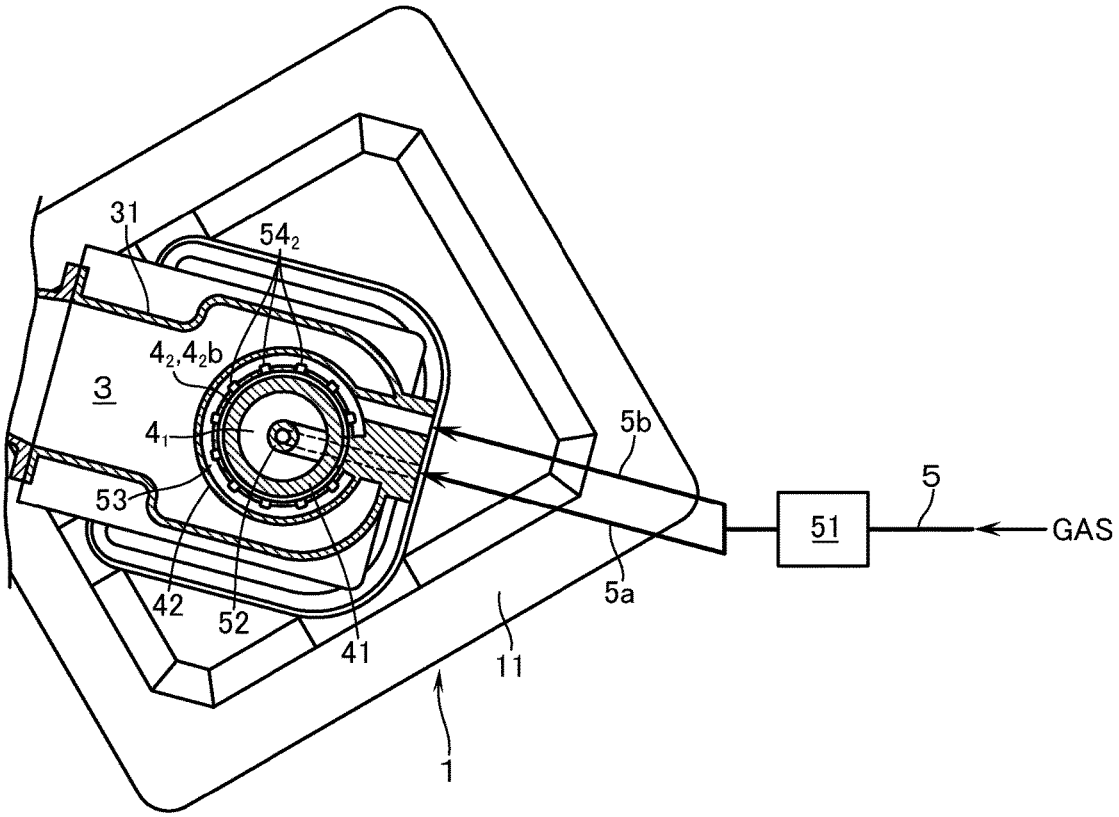
FIG. 3 is a sectional view taken along the line III-III in FIG. 2.

With reference to FIGS. 2 and 3, a gas supply passage 5 to supply fuel gas to the burner 1 is provided with a zero governor 51 which inputs an internal pressure in the air supply chamber 3 as a control pressure through a pressure detecting passage 51*a* so as to adjust the secondary gas pressure (the pressure of the fuel gas to be supplied to the downstream side) to a pressure equivalent to the internal pressure in the air supply chamber 3. Further, the first mixing passage $\mathbf{4}_1$ is provided, inside thereof, with a bottomed tubular gas tube 52 which is coaxial with the inner tube 41. A substantially annular gas chamber 53 is formed inside the tubular wall portion of the outer tube 42. The gas supply passage 5 is then branched into two passages 5*a*, 5*b* on the downstream side of the zero governor 51. One 5*a* of the branched passages is connected to the gas tube 52, and the other 5*b* of the branched passages is connected to the gas chamber 53. A first gas outlet port $\mathbf{54}_1$ is disposed at one end of the gas tube 52, and there is disposed a cup-shaped gas valve 55 which is capable of closing the first gas outlet port $\mathbf{54}_1$. It is thus so arranged that the first gas outlet port $\mathbf{54}_1$ is in communication, through the space on the inner side of the gas valve 55, with the first narrowed part $\mathbf{4}_1b$ on the circumference of the gas valve 55. Further, the outer tube 42 has formed therein a plurality of the second gas outlet ports $\mathbf{54}_2$ at a circumferential distance from one another so as to be in communication with the second narrowed parts $\mathbf{4}_2b$.

It is to be noted here that the differential pressure between the internal pressure in the air supply chamber 3 and the internal pressure in each of the first and the second narrowed parts $\mathbf{4}_1b$, $\mathbf{4}_2b$ varies in proportion to the amount of primary air that flows through each of the first and the second mixing passages $\mathbf{4}_1$, $\mathbf{4}_2$. Then, the amount of supply of the fuel gas from each of the first and the second gas outlet ports $\mathbf{54}_1$, $\mathbf{54}_2$ which are in communication with each of the first and the second narrowed parts $\mathbf{4}_1b$, $\mathbf{4}_2b$ varies in proportion to the differential pressure between the secondary gas pressure that is equivalent to the internal pressure in the air supply chamber 3, and the internal pressure in each of the first and the second narrowed parts $\mathbf{4}_1b$, $\mathbf{4}_2b$, i.e., varies in proportion to the amount of the primary air that flows through each of the mixing passages $\mathbf{4}_1$, $\mathbf{4}_2$. Therefore, by controlling the number of revolution of the combustion fan 2 according to the required combustion amount, the primary air and the fuel gas according to the required combustion amount come to be supplied to the burner 1. However, once the number of revolution of the combustion fan 2 has fallen below the lower-limit number of revolution at which the proportional characteristics of the air supply amount can be maintained, the amount of the primary air and the fuel gas according to the required combustion amount can no longer be supplied.

As a solution, there are disposed a first air adjusting valve $\mathbf{6}_1$ which varies the opening degree of the first air inlet port $\mathbf{4}_1a$, and a second air adjusting valve $\mathbf{6}_2$ which varies the opening degree of the second air inlet port $\mathbf{4}_2a$. Suppose: that the direction opposite to the first and the second air inlet ports $\mathbf{4}_1a$, $\mathbf{4}_2a$ is defined as an X-axis direction; that, in the X-axis direction, the direction approaching the first and the second air inlet ports $\mathbf{4}_1a$, $\mathbf{4}_2a$ is defined as an X-axis plus direction; and that the direction leaving away from both the first and the second air inlet ports $\mathbf{4}_1a$, $\mathbf{4}_2a$ is defined as an X-axis minus direction. Then, both the first and the second air adjusting valves $\mathbf{6}_1$, $\mathbf{6}_2$ are made to be moved in the X-axis direction by a common actuator 7.

The actuator 7 is constituted by a motor 71, and a feed screw mechanism 72 on an output side thereof. The feed screw mechanism 72 is constituted by: a nut 73 driven for rotation by the motor 71; a rod 74 having a male thread portion which is engaged with the nut 73 in a screwed manner; and a guide sleeve 75 which supports the rod 74 in a penetrating manner while preventing it from rotating. As a result of operation of the motor 71, the rod 74 is movable back and forth in the X-axis direction. Further, there is provided a telescopic rod 76 which protrudes in the X-axis plus direction and which is slidable relative to the rod 74. The first air adjusting valve $\mathbf{6}_1$ is fixed to the telescopic rod 76 and, positioned in the X-axis minus direction than is the first air adjusting valve $\mathbf{6}_1$, the second air adjusting valve $\mathbf{6}_2$ is fixed to the rod 74, Further, a spring 77 is interposed between the first air adjusting valve $\mathbf{6}_1$ and the second air adjusting valve $\mathbf{6}_2$. Then, as a result of the operation of the actuator 7, when both the first and the second air adjusting valves $\mathbf{6}_1$, $\mathbf{6}_2$ are moved in the X-axis plus direction, before the second air adjusting valve $\mathbf{6}_2$ reaches a totally closed position at which the second air inlet port $\mathbf{4}_2$ is closed, the first air adjusting valve $\mathbf{6}_1$ reaches a totally closed position at which the first air inlet port $\mathbf{4}_1a$ is closed. Once the first air adjusting valve $\mathbf{6}_1$ has reached the totally closed position, the second air adjusting valve $\mathbf{6}_2$ is arranged to be moved in the X-axis plus direction while compressing the spring 77.

Further, in order for the gas valve 55 to be mechanically coupled to the first air adjusting valve $\mathbf{6}_1$, the gas valve 55 is fixed to the telescopic rod 76. Then, when the first air adjusting valve $\mathbf{6}_1$ has reached the totally closed position in which the first air inlet port $\mathbf{4}_1a$ is closed, the first gas outlet port $\mathbf{54}_1$ is arranged to be closed by the gas valve 55. By the way, in order to prevent the telescopic rod 76 from getting pulled out of position relative to the rod 74, there is attached, at an end portion in the X-axis minus direction, of the telescopic rod 76 a cross pin 76*a* which is engaged with a slit 74*a* formed in the rod 74 in a manner to be elongated in the X-axis direction.

In the combustion apparatus according to this embodiment, as a control mode in which the controller (not illustrated) performs, there are: a high-performance mode in which both the first and the second air inlet ports $\mathbf{4}_1$, $\mathbf{4}_2$ are opened by both the first and the second air adjusting valves $\mathbf{6}_1$, $\mathbf{6}_2$, thereby allowing the primary air to flow through both the first and the second mixing passages $\mathbf{4}_1$, $\mathbf{4}_2$; and a low-performance mode in which the first air inlet port $\mathbf{4}_1a$ is closed by the first air adjusting valve $\mathbf{6}_1$, thereby allowing the primary air to flow only through the second mixing passage $\mathbf{4}_2$ and also the first gas outlet port $\mathbf{54}_1$ is closed by the gas valve 55, thereby preventing the fuel gas from flowing out of the first gas outlet port $\mathbf{54}_1$.

The high-performance mode includes: an opening degree variable mode in which, in a state in which the number of revolution of the combustion fan 2 is maintained at a predetermined lower-limit number of revolution, the opening degree of the first air inlet port $\mathbf{4}_1a$ is varied, within a range above a lower-limit opening degree, according to a required combustion amount of the burner 1; and a number-of-fan-revolution variable mode in which, in a state in which the opening degree of the first air inlet port $\mathbf{4}_1a$ is maintained above a maximum opening degree in the opening degree variable mode, the number of revolution of the combustion fan 2 is varied, within a range above the predetermined lower-limit number of revolution of the combustion fan 2, according to the required combustion amount of the burner. In addition, the low-performance mode includes: an opening degree variable mode in which, in a state in which the number of revolution of the combustion fan 2 is maintained at the predetermined lower-limit number of revolution, the opening degree of the second air inlet port $\mathbf{4}_2a$ is varied, within a range above a predetermined lower-limit opening degree, according to a required combustion amount of the burner 1; and a number-of-fan-revolution variable mode in which, in a state in which the opening degree of the second air inlet port $\mathbf{4}_2a$ is maintained above a maximum opening degree in the opening degree variable mode, the number of revolution of the combustion fan 2 is varied, within a range above the lower-limit number of revolution, according to the required combustion amount of the burner.

Here, the lower-limit opening degree of each of the first and the second air inlet ports $\mathbf{4}_1a$, $\mathbf{4}_2a$ means a lower limit of the opening degree range at which no variation occurs in the primary air amount due to minute displacements of each of the first and the second air adjusting valves $\mathbf{6}_1$, $\mathbf{6}_2$. Suppose that the opening degree at which the area of the clearance between the periphery of each of the first and the second air inlet ports $\mathbf{4}_1a$, $\mathbf{4}_2a$ and each of the first and the second air adjusting valves $\mathbf{6}_1$, $\mathbf{6}_2$ becomes equal to the cross-sectional area of each of the first and the second narrowed parts $\mathbf{4}_1b$, $\mathbf{4}_2b$ is defined as a fully opened opening degree. In this embodiment, the maximum opening degree in the opening degree variable mode of each of the high-performance and low-performance modes is maintained at the fully opened opening degree and, in the number-of-fan-revolution variable mode, the opening degree of each of the first and the second air inlet ports $\mathbf{4}_1a$, $\mathbf{4}_2a$ is maintained above the fully opened opening degree. Further, at the point of time in which the first air adjusting valve $\mathbf{6}_1$ has reached the totally closed position, the opening degree of the second air adjusting valve $\mathbf{6}_2$ is present at a position above the maximum opening degree in the opening degree variable mode of the low-performance mode, i.e., at a position above the fully opened opening degree. In the high-performance mode, the opening degree of the second air inlet port $\mathbf{4}_2a$ is maintained above the fully opened opening degree. Further, even if the first air adjusting valve $\mathbf{6}_1$ is moved in the X-axis plus direction to the position in which the opening degree of the first air inlet port $4_1a$ becomes lower-limit opening degree, the amount of fuel gas from the first gas outlet port $54_1$ will never be regulated by the gas valve 55.

Figure 4:
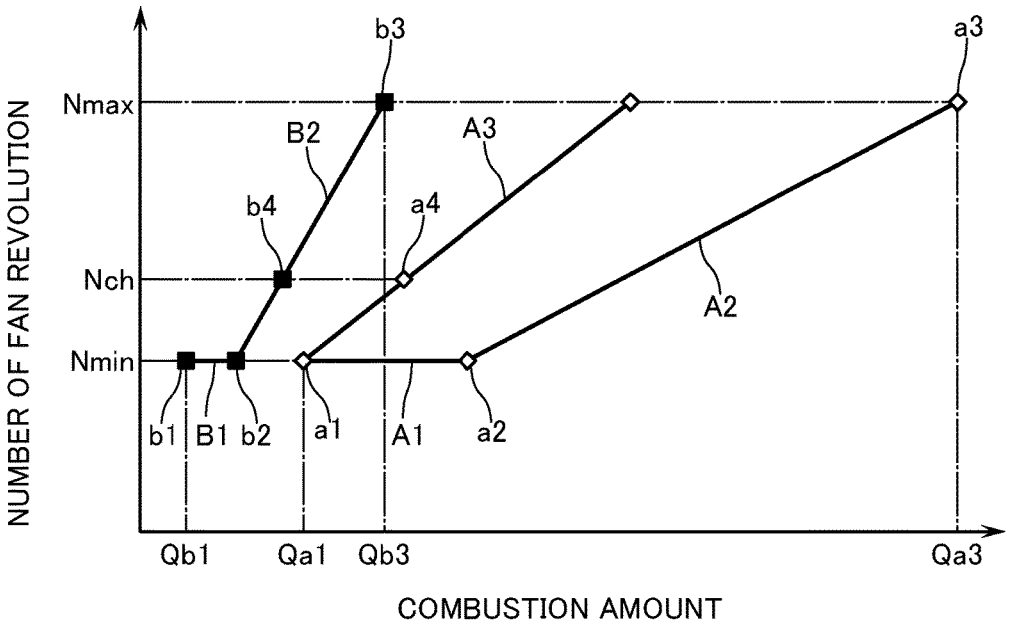
FIG. 4 is a graph showing the change characteristics of the burner combustion amount in the combustion apparatus according to an embodiment of this invention.

FIG. 4 shows the change characteristics of the combustion amount of the burner 1 in each of the high-performance and low-performance modes. In the opening degree variable mode of the high-performance mode, when the opening degree of the first air inlet port $4_1a$ is increased from the lower-limit opening degree to the fully opened opening degree, changes are made along line A1 in FIG. 4 from the state at point a1 to point a2. In the number-of-fan-revolution variable mode of the high-performance mode, when the number of revolution of the combustion fan 2 is increased from the lower-limit number of rotation Nmin to a predetermined upper limit number of revolution Nmax, changes are made along line A2 in FIG. 4 from the state of point a2 to point a3. Further, in the opening degree variable mode of the low-performance mode, when the opening degree of the second air inlet port $4_2a$ is increased from the lower-limit opening degree to the fully opened opening degree, changes are made along line B1 in FIG. 4 from the state of point b1 to point b2. In the number-of-fan-revolution variable mode of the low-performance mode, when the number of revolution of the combustion fan 2 is changed from the lower-limit number of revolution Nmin to a predetermined upper limit number of revolution Nmax, changes are made along line B2 in FIG. 4 from the state of point b2 to point b3.

According to this embodiment, in the low-performance mode the primary air flows only through the second mixing passage 42. Therefore, the amount of the primary air when the opening degree of the second air inlet port $4_2a$ in the opening degree variable mode of the low-performance mode is throttled to the lower-limit opening degree, will be considerably smaller as compared with the amount of the primary air when the mixing passage is not branched into both the first and the second mixing passages and, as a result, the opening degree of a single air inlet port of the mixing passage is throttled to the lower-limit opening degree. As a consequence, the combustion amount Qb1 at point b1 in FIG. 4, which is the minimum combustion amount in the low-performance mode, can be made considerably small. Then, the turndown ratio, i.e., the ratio of that combustion amount Qa3 at point a3 in FIG. 4 which is the maximum combustion amount in the high-performance mode to the combustion amount Qb1, can be made large to the extent possible.

By the way, when the low-performance mode is switched to the high-performance mode due to an increase in the required combustion amount, the number of revolution of the combustion fan 2 is changed to a switching number of revolution Nch and, then, the first air adjusting valve $6_1$ is moved so that the opening degree of the first air inlet port $4_1a$ becomes the lower-limit opening degree. According to this arrangement, transfer will be made to the state at point a4 on line A3, in FIG. 4, which is the characteristic curve in case the number of revolution of the combustion fan 2 is varied in a state in which the opening degree of the first air inlet port $4_1a$ is maintained at the lower-limit opening degree. As a result, large changes in the combustion amount at the time of switching from the low-performance mode to the high-performance mode can be restrained. Thereafter, the number of revolution of the combustion fan 2 and the opening degree of the first air inlet port $4_1a$ are appropriately adjusted according to the required combustion amount. Further, when the high-performance mode is switched to the low-performance mode due to a decrease in the required combustion amount, the opening degree of the first air inlet port $4_1a$ is made to the lower-limit opening degree and then the number of revolution of the combustion fan 2 is changed to the switching number of revolution Nch and, subsequently, the first air adjusting valve $6_1$ is moved to the totally closed position. According to this arrangement, transfer will be made to the state at point b4 on line B2 in FIG. 4 and thereafter the number of revolution of the combustion fan 2 and the opening degree of the second air inlet port $4_2a$ will be appropriately adjusted according to the required combustion amount.

By the way, in the above-mentioned embodiments, the zero governor 51 is interposed in the gas supply passage 5. Alternatively, a proportional valve may be interposed in place of the zero governor. In this case, the electric current to be supplied to the proportional valve (proportional valve current) is controlled, and the feed amount of the fuel gas is made variable by the proportional valve from the amount corresponding to the minimum combustion amount Qa1 at point a1 in FIG. 4 in the high-performance mode to the amount corresponding to maximum combustion amount Qa3 at point a3. Further, in the low-performance mode the first gas outlet port $54_1$ is closed by the gas valve 55 and, therefore, even if the proportional valve current may be equal to each other, the amount of supply of the fuel gas becomes smaller than that in the high-performance mode. Then, the feed amount of the fuel gas is made variable by the proportional valve from the amount corresponding to the minimum combustion amount Qb1 at point b1 in FIG. 4 in the low-performance mode to the amount corresponding to the maximum combustion amount Qb3 at point b3.

By the way, in the arrangement in which a proportional valve is interposed in the gas supply passage 5, each of the first and the second mixing passages $4_1$, $4_2$ need not always be provided with each of the first and the second narrowed parts $4_1b$, $4_2b$. Further, each of the first and the second mixing passages $4_1$, $4_2$ may be disposed on the upstream side of the combustion fan 2, instead of between the combustion fan 2 and the burner 1.

Description has so far been made of embodiments of this invention with reference to the drawings, but this invention shall not be limited to the above. For example, it is possible to move each of the first and the second air adjusting valves $6_1$, $6_2$ by separate actuators, respectively. Further, as a gas valve to prevent the fuel gas from the first gas outlet port $54_1$ from flowing out, it is possible to interpose an electromagnetic valve in the branch passage 5*a* that is connected to the gas tube 52. However, by employing an arrangement in which both the first and the second air adjusting valves $6_1$, $6_2$ are moved by the common actuator 7 and an arrangement in which the gas valve 55 is constituted by a valve which is mechanically coupled to the first air adjusting valve $6_1$ and which is capable of closing the first gas outlet port $54_1$, cost down can advantageously be attained. In addition, in the above-mentioned embodiment, the actuator 7 is constituted by the motor 71 and the feed screw mechanism 72. However, it is also possible to use other actuators such as an electromagnetic solenoid and the like.

Explanation of Reference Characters

| | | | |
|---|---|---|---|
| 1 | burner | 2 | combustion fan |
| 3 | air supply chamber | $4_1$ | first mixing passage |
| $4_1$a | first air inlet port | $4_1$ b | first narrowed part |
| $4_2$ | second mixing passage | $4_2$ a | second air inlet port |
| $4_2$ b | second narrowed part | 5 | gas supply passage |
| 51 | zero governor | $54_1$ | first gas outlet port |

-continued

| Explanation of Reference Characters | | | |
|---|---|---|---|
| $54_2$ | second gas outlet port | 55 | gas valve |
| $6_1$ | first air adjusting valve | $6_2$ | second air adjusting valve |
| 7 | actuator | 77 | spring |

The invention claimed is:

1. A combustion apparatus comprising:

a burner;

a combustion fan for supplying the burner with primary air;

an upstream-side air supply chamber and a plurality of downstream-side mixing passages, both being interposed between the combustion fan and the burner;

a zero governor which is interposed in a gas supply passage for supplying the burner with fuel gas and which adjusts a secondary gas pressure to a pressure equivalent to an internal pressure in the air supply chamber, the mixing passages having disposed therein a plurality of narrowed parts in order to accelerate a flow speed of the primary air, thereby making an internal pressure lower than the internal pressure in the air supply chamber, the narrowed parts having communicated thereto a plurality of gas outlet ports at a downstream end of the gas supply passage; and a plurality of air adjusting valves which vary an opening degree of a plurality of air inlet ports at an upstream end of the plurality of the mixing passages, wherein the improvement comprises:

as the plurality of the mixing passages, there are disposed: a first mixing passage; and a cylindrical second mixing passage enclosing the first mixing passage;

as the plurality of the gas outlet ports, there are disposed: a first gas outlet port which is in communication with a first narrowed part of the plurality of the narrowed parts which is disposed in the first mixing passage; and a second gas outlet port which is in communication with a second narrowed part of the plurality of the narrowed parts which is disposed in the second mixing passage and; and a gas valve in a manner to be capable of stopping the flow of the fuel gas from the first gas outlet port;

as the plurality of the air adjusting valves, there are disposed: a first air adjusting valve which varies the opening degree of a first air inlet port of the plurality of the air inlet port at an upstream end of the first mixing passage; and a second air adjusting valve which varies the opening degree of a second air inlet port of the plurality of the air inlet port at an upstream end of the second mixing passage;

as a control mode there are included: a high-performance mode in which both the first and the second air inlet ports are opened by both the first and the second air adjusting valves, thereby allowing the primary air to flow through both the first and the second mixing passages; and a low-performance mode in which the first air inlet port is closed by the first air adjusting valve, thereby allowing the primary air to flow only through the second mixing passage and, also, stopping by the gas valve the gas flow from the first gas outlet port, the high-performance mode including: an opening degree variable mode in which, in a state in which the number of revolution of the combustion fan is maintained at a predetermined lower-limit number of revolution, the opening degree of the first air inlet port is varied, within a range above a predetermined lower-limit opening degree, according to a required combustion amount of the burner; and a number-of-fan-revolution variable mode in which, in a state in which the opening degree of the first air inlet port is maintained above a maximum opening degree in the opening degree variable mode, the number of revolution of the combustion fan is varied, within a range above the predetermined lower-limit number of revolution of the combustion fan, according to the required combustion amount of the burner, and the low-performance mode including: an opening degree variable mode in which, in a state in which the number of revolution of the combustion fan is maintained at a predetermined lower-limit number of revolution, the opening degree of the second air inlet port is varied, within a range above a predetermined lower-limit opening degree, according to a required combustion amount of the burner; and a number-of-fan-revolution variable mode in which, in a state in which the opening degree of the second air inlet port is maintained above a maximum opening degree in the opening degree variable mode, the number of revolution of the combustion fan is varied, within a range above the lower-limit number of revolution of the combustion fan, according to the required combustion amount of the burner.

2. The combustion apparatus according to claim 1, further comprising:

suppose that a direction opposite to both the first and the second air inlet ports is defined as an X-axis direction and that, in the X-axis direction, the direction approaching both the first and the second air inlet ports is defined as X-axis plus direction, a common actuator which is adapted to move both the first and the second air adjusting valves in the X-axis direction such:

that when both the first and the second air adjusting valves are moved in the X-axis plus direction, before the second air adjusting valve reaches a totally closed position at which the second air inlet port is closed, the first air adjusting valve reaches a totally closed position at which the first air adjusting valve closes the first air inlet port;

that a spring is interposed between the first air adjusting valve and the second air adjusting valve such that, once the first air adjusting valve has reached the totally closed position, the second air adjusting valve is moved, while compressing the spring, in the X-axis plus direction; and also that, at the time point when the first air adjusting valve has reached the totally closed position, the second air adjusting valve is present at a position in which the opening degree of the second air inlet port is above the maximum opening degree in the opening degree variable mode of the low-performance mode.

3. The combustion apparatus according to claim 1, wherein the gas valve is constituted by a valve which is mechanically connected to the first air adjusting valve and which is capable of closing the first gas outlet port and wherein, when the first air adjusting valve has reached the totally closed position at which the first air inlet port is closed, the gas valve closes the first gas outlet port.

4. A combustion apparatus comprising:

a burner;

a combustion fan for supplying the burner with primary air;

a plurality of mixing passages disposed between the combustion fan and the burner or on an upstream side of the combustion fan;

a proportional valve interposed in a gas supply passage which supplies the burner with fuel gas, a plurality of gas outlet ports at a downstream end of the gas supply passage being in communication with the plurality of the mixing passage; and a plurality of air adjusting valves which vary an opening degree of the air inlet port at an upstream end of the plurality of the mixing passages, wherein the improvement comprises:

as the plurality of the mixing passages, there are disposed: a first mixing passage; and a cylindrical second mixing passage enclosing the first mixing passage;

as the plurality of the gas outlet ports, there are disposed: a first gas outlet port which is in communication with the first mixing passage; and a second gas outlet port which is in communication with the second mixing passage; and a gas valve which is disposed in a manner to be capable of stopping the flow of the fuel gas out of the first gas outlet port;

as the plurality of the air adjusting valves, there are disposed: a first air adjusting valve which varies the opening degree of a first air inlet port of the plurality of the air inlet port at an upstream end of the first mixing passage; and a second air adjusting valve which varies the opening degree of a second air inlet port of the plurality of the air inlet port at an upstream end of the second mixing passage;

as a control mode there are included: a high-performance mode in which both the first and the second air inlet ports are opened by both the first and the second air adjusting valves, thereby allowing the primary air to flow through both the first and the second mixing passages, and fuel gas in an amount corresponding to the required amount of combustion of the burner is supplied by the proportional valve; and a low-performance mode in which the first air inlet port is closed by the first air adjusting valve, thereby allowing the primary air to flow only through the second mixing passage and also in a state in which the flow of the fuel gas out of the first gas outlet port is stopped by the gas valve, the fuel gas in an amount corresponding to the required amount of combustion of the burner is supplied by the proportional valve, the high-performance mode including: an opening degree variable mode in which, in a state in which the number of revolution of the combustion fan is maintained at a predetermined lower-limit number of revolution, the opening degree of the first air inlet port is varied, within a range above a predetermined lower-limit opening degree, corresponding to a required combustion amount of the burner; and a number-of-fan-revolution variable mode in which, in a state in which the opening degrees of the first and the second air inlet ports are maintained above a maximum opening degree in the opening degree variable mode, the number of revolution of the combustion fan is varied, within a range above the lower-limit number of revolution of the combustion fan, according to the required combustion amount of the burner, and the low-performance mode including: an opening degree variable mode in which, in a state in which the number of revolution of the combustion fan is maintained at a predetermined lower-limit number of revolution, the opening degree of the second air inlet port is varied, within a range above a predetermined lower-limit opening degree, according to a required combustion amount of the burner; and a number-of-fan-revolution variable mode in which, in a state in which the opening degree of the second air inlet port is maintained above a maximum opening degree in the opening degree variable mode, the number of revolution of the combustion fan is varied, within a range above the lower-limit number of revolution of the combustion fan, according to the required combustion amount of the burner.

5. The combustion apparatus according to claim 4, wherein the gas valve is constituted by a valve which is mechanically connected to the first air adjusting valve and which is capable of closing the first gas outlet port and wherein, when the first air adjusting valve has reached the totally closed position at which the first air inlet port is closed, the gas valve closes the first gas outlet port.

* * * * *